United States Patent [19]

Iyeta

[11] 4,145,945

[45] Mar. 27, 1979

[54] ELECTRONIC MUSICAL INSTRUMENT EMPLOYING HOLOGRAPHIC MEMORY

[75] Inventor: Motoi Iyeta, Hamakita, Japan

[73] Assignee: Nippon Gakki Seizo Kabushiki Kaisha, Hamamatsu, Japan

[21] Appl. No.: 808,388

[22] Filed: Jun. 20, 1977

[30] Foreign Application Priority Data

Jun. 21, 1976 [JP] Japan ..... 51/72144

[51] Int. Cl.[2] ..... G10H 3/06

[52] U.S. Cl. ..... 84/1.18

[58] Field of Search ..... 84/1.01, 1.18, 1.28, 84/DIG. 29

[56] References Cited

U.S. PATENT DOCUMENTS

| | | | |
|---|---|---|---|
| 3,098,889 | 7/1963 | Buitkus | 84/1.18 |
| 3,484,530 | 12/1969 | Rupert | 84/1.18 |
| 3,652,776 | 3/1972 | Milde, Jr. | 84/1.28 |
| 3,810,106 | 5/1974 | Nadler et al. | 84/1.01 X |

FOREIGN PATENT DOCUMENTS

| | | | |
|---|---|---|---|
| 41-18291 | 10/1966 | Japan | 84/DIG. 29 |

*Primary Examiner*—Stanley J. Witkowski

*Attorney, Agent, or Firm*—Cushman, Darby & Cushman

[57] ABSTRACT

An electronic musical instrument of the waveshape memory type comprises a holographic memory; including a plurality of hologram pictures each carrying information of dots which represent in binary coded notation sample values constituting musical waveshapes. Upon key depression, a coherent light beam irradiates the hologram pictures corresponding to the depressed key to reproduce dot images on a photo-electric converter. The converter delivers digital values of waveshape samples. The digital values are converted to analog values, thereby producing musical tones. A large amount of information can be stored in a small size memory.

6 Claims, 12 Drawing Figures

ELECTRONIC MUSICAL INSTRUMENT EMPLOYING HOLOGRAPHIC MEMORY

BACKGROUND OF THE INVENTION (a) Field of the invention

The present invention relates to an electronic musical instrument, and more particularly it pertains to an electronic musical instrument of the waveshape memory type in which the waveshapes of musical sounds of various natural musical instruments, synthesized musical sounds and/or various effects (totally referred to as musical sounds or tones hereinbelow) are stored in a memory medium, and a particular musical sound waveshape is read out from the memory medium in response to a key depression to generate a desired musical sound.

(b) Description of the prior art

The electronic musical instrument of the waveshape memory type has a clear advantage over that of the waveshape generation type in the following aspects: that musical sounds of high fidelity resembling those of the natural musical instruments can be generated easily since the former, i.e. the waveshape memory type, generates a musical sound by reading the memorized musical sound waveshape whereas the latter, i.e. the waveshape generation type, generates a musical sound by combining the basic tone waveforms such as a group of sinusoidal waveforms. In this specification, the term "waveshape" is used to denote a combination of waveforms, such as those of sinusoidal, saw-tooth, square, and so forth. Standing on the above advantage, various proposals have been made in the past to provide electronic musical instruments of the waveshape memory type, but no electronic musical instruments which have been proposed in the past are able to provide a performance ability competitive with the natural musical instruments while satisfying the practical requirements such as a low manufacturing cost, compact size and easy maintenance.

For example, Japanese Patent Publication No. 41-18291 (U.K. patent application No. 18269/62) discloses an electronic musical instrument of the magnetic tape memory type in which magnetic tapes of finite length are provided, respectively, for the keys of a keyboard of the instrument, and a particular magnetic tape is selected upon the operation of a key to generate a corresponding tone. This prior art electronic musical instrument, however, has many problems to be improved. For example, according to this system, a very complicated driving mechanism is required for immediately bringing the memory initiation point of an assigned magnetic tape corresponding to a depressed key to the position at a reproduction head and also for running the magnetic tape to reproduce a sound without any time delay after the key operation. In particular, in case a particular key is repeatedly operated (depressed and released) within a very short period, it is very difficult, or almost impossible, to bring, at every depression, the memorized wave initiation point of the magnetic tapes to the reproduction head and to feed them to generate the desired tone signals in response to the key operations without any time delay since a magnetic tape is a serial access type memory medium, and since the reproduction of the memory requires physical movement of this tape. Furthermore, a magnetic tape has the drawback that the reproduced tone quality may be deteriorated by the hysteresis distortion, extension and wear of the magnetic tape itself, while it has the advantage that the recording and the reproduction of the memory is easily performed. Yet further, the provision of magnetic tapes in a number equal to that of the keys and the provision of a driving mechanism for these magnetic tapes will make the entire electronic musical instrument large in size and expensive. Thus, the electronic musical instrument of the magnetic tape memory type is unable to satisfy the practical requirements.

U.S. Pat. No. 3,098,889 issued to T. J. Buitkus on July 23, 1963 discloses another example of an electronic musical instrument of the waveshape memory type. In this electronic musical instrument, a multiplicity of coaxial circular memory tracks are formed by coating a photomask on a disk which has an underlie of photoelectric material. Tone waveshapes are recorded in the respective tracks as an optical pattern of opacity. While the disk is rotated, a light beam is irradiated onto a selected track. Then, the intensity of the light beam incident onto the photo-electric material varies with time in accordance with the opacity pattern in the mask, resulting in changes in the resistance or the electromotive force of the photo-electric material on the disk. Thus, an electric tone signal corresponding to the optical pattern of the tone waveshape information recorded in that track is produced. According to such a system, however, there can be produced no tone signal the amplitude and/or pitch of which changes with time since the disk is continuously and constantly rotated and since the memory read-out is commenced at any point in the track and repeatedly continues as long as the beam is being irradiated. In general, a natural musical sound such as the sound of a piano is such that its amplitude and the pitch vary instantaneously from the time a key is depressed up to the time the tone generation is terminated. According to the above U.S. Pat. No. 3,098,889 electronic musical instrument, tone waveshape is reproduced from an arbitrary point in an endless track, and therefore the tone waveshape that can be recorded in each track is limited to a burst waveshape, and accordingly time-dependent variations of the amplitude and the pitch of the tone as those of the natural musical sound cannot be provided.

As has been described above, conventional electronic musical instruments of the waveshape memory type which have been provided in the past have many problems that require to be improved. Such problems can be ascribed to the inherent property of the recording medium for recording the tone waveshape. An improvement of the read-out speed of the tone waveshape can be achieved by the employment of the generally known high speed random access memories such as core memory, semiconductor memory, and the like. In an electronic musical instrument, however, a considerably large memory capacity is required for recording the tone waveshape (for example, each 5 ms sample values for 4 sec single tone generation amount to 800 sample values, and 88 kinds of tone will require over 70 thousands sample values). When a core memory of such memory capacity with necessary terminal devices such as read-write circuit is employed, the result will be that the fabricated electronic musical instrument will be large in size and expensive. In particular, the problem in the manufacturing cost almost prohibits the use of such core memory.

SUMMARY OF THE INVENTION

An object of the present invention, therefore, is to provide an electronic musical instrument of the waveshape memory type, which is capable of eliminating those drawbacks of the known waveshape memory type electronic musical instruments as described above.

Another object of the present invention is to provide an electronic musical instrument of the waveshape memory type as described above, which is capable of generating musical tones the amplitude and the pitch of which vary with time.

A further object of the present invention is to provide an electronic musical instrument of the waveshape memory type as described above, which has excellent performance abilities competitive with natural keyboard musical instruments such as piano.

A still further object of the present invention is to provide a small-sized and low-cost electronic musical instrument of the waveshape memory type as described above, which is capable of generating a variety of musical sounds resembling those of natural musical instruments.

According to an aspect of the present invention, there is employed a holographic memory as a means for recording tone waveshapes in an electronic musical instrument, and tone waveshapes corresponding to the notes of the respective keys in a keyboard are recorded as holographic images (holograms) of coded information in particular positions in the holographic memory. The holographic memory which is employed can store the tone waveshape information in a small area with high density, and yet the cost thereof is low. Furthermore, since the holographic memory enables a random access and a high speed read-out, the read-out of the required tone waveshape can be attained in response to a key operation without any substantial time delay to accomplish a good performance. Also, since the holographic memory has a high redundancy due to its interfering nature, the positional control of the reading light beam is easy. Therefore, the electronic musical instrument according to the present invention can have a compact size and is economical while being able to exhibit an excellent performance.

According to an embodiment of the present invention, a holographic memory for storing tone waveshapes is constituted of a matrix of pages (pictures) arranged in rows and columns. Each row in this page matrix is uniquely assigned to each single key of a keyboard, and columns of the matrix correspond to the lapse of time of a musical tone. Namely, the tone waveshape information of a depressed key as a function of time is converted to holographic images at a certain time interval and they are stored in the succeeding column pages of a corresponding row of the page matrix. The read-out of the tone waveshape is accomplished by scanning a coherent beam on a particular row in the direction of the succeeding column. By this scanning, the tone waveshape information stored in the succeeding column pages of a particular row is converted to optical images of a plurality of dots representing in binary notation the waveshape samples and further they are converted to electric signals in a photoelectric converter. This electric signal is inputted into an audio device in a predetermined form to generate a musical sound therefrom.

According to another aspect of the present invention, a corresponding plurality of rows of a page matrix for a plurality of keys being operated are multi-scanned in time-sharing manner. In such multi-scanning, each page area is to be scanned in a period appropriately shorter than the real time. The optical image of the tone waveshape corresponding to a depressed key read out by this scanning is converted to an electric signal at a timing which is determined by the scanning timing. This electrical signal is expanded to the real time base and is sounded from an audio device. When a multiplicity of keys are being depressed, the multiplicity of corresponding musical tones are superimposed. Thus, there is provided a multi-tone electronic musical instrument which is capable of generating a plurality of tones corresponding to the simultaneously depressed keys.

According to another aspect of the present invention, tone waveshape information is converted to digital quantities, and they are represented by dot images. The holographic image of a dot pattern is a kind of small-object hologram, which can be re-transformed into real optical image with a single coherent light beam with good reproducibility. Furthermore, the discrimination of the black-white level of each dot can be accomplished easily.

These and other objects, and the features as well as the advantages of the present invention will become apparent from the following detailed description of the preferred embodiments when taken in conjunction with the accompanying drawings.

DESCRIPTION OF THE PREFERRED EMBODIMENTS

Figure 1:
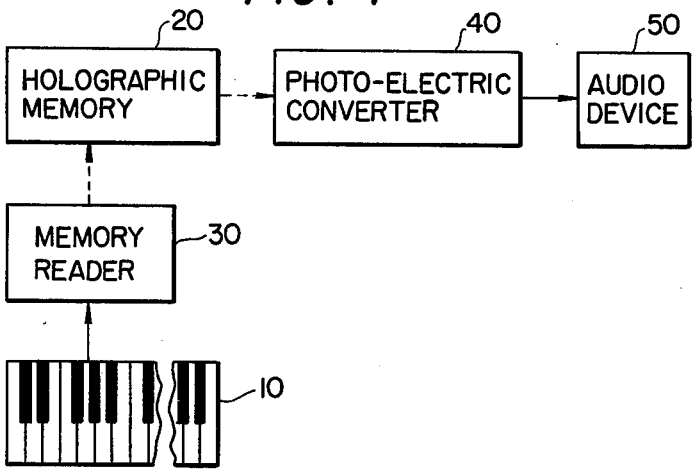
FIG. 1 is a block diagram of an electronic musical instrument according to the basic embodiment of the present invention.
Figure 2:
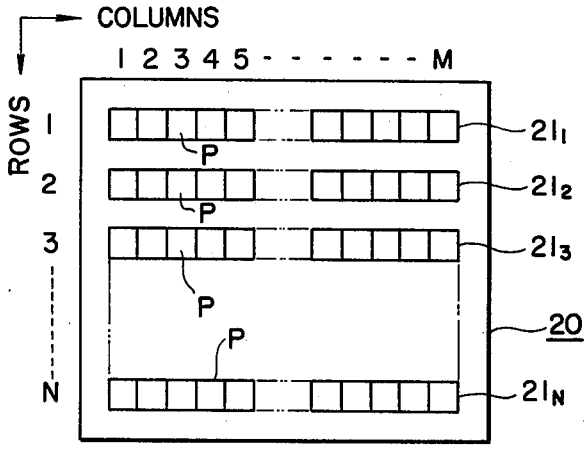
FIG. 2 is a schematic diagram of an example of the holographic memory used in the system of FIG. 1.
Figure 3:
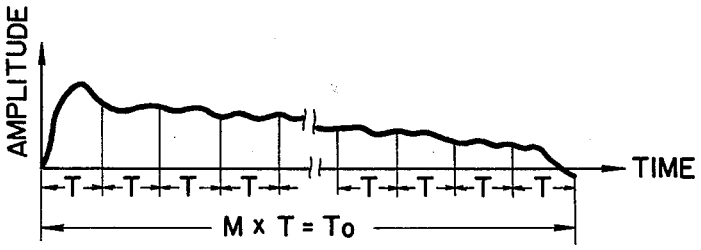
FIG. 3 is a schematic diagram showing the envelope of a tone waveshape for illustrating the memory content in respective pages of the holographic memory.

FIGS. 1 to 3 show a basic structure of the electronic musical instrument according to an embodiment of the present invention.

In FIG. 1, a keyboard 10 including a multiplicity (N-number) of keys supplies key-on, key-off and key-identifying (address) signals to a memory accessor or reader 30 in response to the key operations in the keyboard. The memory accessor 30 accesses identifies pages in a holographic memory 20 successively corresponding to the depressed keys in the keyboard to form optical images carrying the waveshape information on a photo-electric converter 40 in which the optical image of the tone waveshape information which is outputted from the holographic memory 20 is converted to an electric signal. The electric tone signals derived from the converter 40 are converted to musical tones in an audio device 50. Namely, the holographic memory 20, the memory accessor 30 and the photo-electric converter 40 are distinguishably different from the corresponding ones of the conventional electronic musical instruments.

The holographic memory 20 as shown in FIG. 2 is basically an assembly or matrix of N-number of memory bands or rows $\mathbf{21}_1$ to $\mathbf{21}_N$ stacked in the direction of row (Y) with the respective memory bands being directed along the direction of column (X). The N-number of memory rows $\mathbf{21}_1$ to $\mathbf{21}_N$ correspond to the N-number of keys in the keyboard 10. In each of the N-number of memory rows, a tone waveshape of a finite time length corresponding to a depressed key in the keyboard 10 (cf. FIG. 3) is stored in the form of a holographic image (hologram) formed by coherent light beams. The direction of column (X) of the respective rows $\mathbf{21}_1$ to $\mathbf{21}_N$ corresponds to the time axis of the tone waveshape. It is also possible to totally record the information of the tone waveshape for the total time periods ($T_0$ in FIG. 3) in the total region of each memory row (batch recording), but it is preferable to divide each of the respective memory row regions $\mathbf{21}_1$ to $\mathbf{21}_N$ into M-number of small regions (referred to as page hereinbelow) in the direction of column (X), and to form the holographic memory 20 as a page matrix of "N rows × M columns" including M × N pages for enhancing the read-out of the tone waveshape, especially in time-sharing read-out, and for enhancing the conversion of the optical image to electric signals, etc. Thus, the total period $T_0$ of each tone waveshape is divided into a multiplicity of unit time period: $T = T_0/M$ as shown in FIG. 3, and the tone waveshape information for the respective unit periods T is stored in the respective pages P in the form of holograms. Namely, the tone waveshape information in the 1st, 2nd, . . . , M-th unit time periods T of the tome waveshape corresponding to a depressed key is stored in the 1st, 2nd, . . . , M-th pages P of a row in the form of holograms. Here, FIG. 3 shows the envelope of a tone waveshape.

There are various methods or systems for recording the tone waveshape information of a unit period T in each page P, but the selection should be made based on the consideration as to the ease and the reliability of reproduction of the tone waveshape. An example of the preferable method for recording the tone waveshape includes sampling each unit tone waveshapes in each unit time periods T at times of a certain time interval, converting the sample values into coded digital signals of required bit number, further converting the respective digital signals to real dot images through an optical means (for example, developing them on a photosensitive sheet), arranging the dot images of the whole sample values in a unit time period in a predetermined positional relation and totally recording the dot images in a corresponding page P in a hologram. This method is employed in an embodiment of the present invention which will be described later. Here, it is also possible to directly form the hologram of the tone waveshape in a unit period T as analog quantities, but there is a difficulty in keeping high accuracy of the read-out operation of the tone waveshape as will be described later.

When a key in the keyboard is depressed, the memory reader 30 scans the corresponding memory band or row $\mathbf{21}_1, \ldots,$ or $\mathbf{21}_N$ on the holographic memory 20 from the first column to the M-th column, i.e. the M pages P of the i-th row corresponding to the depressed key. This scanning of a row may not necessarily be accomplished by the irradiation of a coherent beam onto the whole area of the M pages continuously, but may be accomplished by irradiating a coherent beam onto an arbitrary portion of each page P for a limited period. This is because the holographic memory has a high redundancy that any part of a hologram contains the information on the whole of the imaged object and hence the whole optical image of the information recorded in the whole area of a hologram can be reproduced by irradiating a coherent beam onto an arbitrary limited portion of the hologram. This property has the remarkable merit that the design and the adjustment of the optical system of the memory reader 30 can be extremely simplified. In other words, if the whole area of each page P is to be uniformly and accurately scanned, an extremely high accuracy light deflector means is required for this scanning. Furthermore, if the continuous scanning is necessary, then a multi-scanning of a plurality of memory bands or rows $\mathbf{21}_1$ to $\mathbf{21}_N$ cannot be easily accomplished in such a manner as is done in the below-mentioned instance.

The optical image of the tone waveshapes which are read out by the above scanning is converted to electric signals by the photo-electric converter 40. This photo-electric converter 40 is assigned to convert the optical image of the tone waveshape in the unit period T which is read out from each page P to electric signals. When the period for irradiating a coherent beam onto each page P is fairly shorter than the unit period T as described above, the whole of the optical image is immediately converted to electric signals in the short irradiation period and the electric signals are outputted at the required timings. An example of the function device having such a storing function is a self-scanning type image sensor (a kind of charge-coupled device) available from Fairchild Co. (U.S.A.) under the model name "CCD201". This device is basically a planar matrix arrangement of a multiplicity of paired image sensors each pair of which is coupled by the charge-coupled technique. It has a function of an analog memory and is capable of shifting out the information in a particular area of the optical image at an arbitrary timing.

The electrical signals supplied from the photo-electrical converter 40 are inputted to an audio device 50 at certain timing with respect to the scanning of the coherent beam, and are sounded as a musical sound therefrom. When the electronic musical instrument is of a polyphonic type, the read-out of the tone waveshapes is accomplished in the time-sharing fashion. The electrical signal corresponding to the read-out tone waveshape is supplied from the photo-electric converter 40 in a contracted time scale than that of the real time. A group of buffer registers of multi-channel each of which works independently of each other is used as such means. Furthermore, when the sample values of the tone waveshape in a unit time period T is first digitalized and then recorded in a hologram in a page P, the audio device 50 includes a digital-to-analog converter.

As has been described above, the electronic musical instrument of the above-stated structure employs a holographic memory for storing the information of tone wavehsape of finite time length, from which the required information is read out optically and then it is converted to electric signals. Remarkable advantages are provided by this arrangement as will be stated hereunder. Rapid read-out of the required tone waveshapes is possible from the holographic memory in response to the key operations. Substantially simultaneous read-out of a plurality of tone waveshapes corresponding to a plurality of depressed keys can be accomplished by the introduction of a time-sharing technique, enabling a high grade performance competitive with the performance of piano and other natural musical instruments. Holographic memory enables a random access read-out and a high density recording, and therefore is fitted for the recording and reproducing of the waveshape information of musical tones, the amplitudes and pitches of which vary with time. Thus, musical tones extremely resembling those of natural musical instruments can be easily generated. Furthermore, the holographic memory can be of a small size and light in weight, and is suitable for being manufactured on a mass-production scale, and hence it is low in the manufacturing cost. Also, the optical reader device is simple in structure and is low in cost as will be appreciated from the following statement. Thus, the above-mentioned structure which is compact in size and low in cost enables the accomplishment of a high-degree performance. Furthermore, the holographic memory has a high redundancy as described above, and hence it allows a large tolerence in the deviation of the relative position with respect to the optical system of the reader device. Thus, exchange of the holographic memory is easy, and also a variety of tone colors may be generated by the substitution of a holographic memory. Yet further, since the holographic memory is of the contactless read-out type, there occurs no deterioration of the quality of the reproduced sounds. These advantages will become more apparent from the following description.

Figure 4:
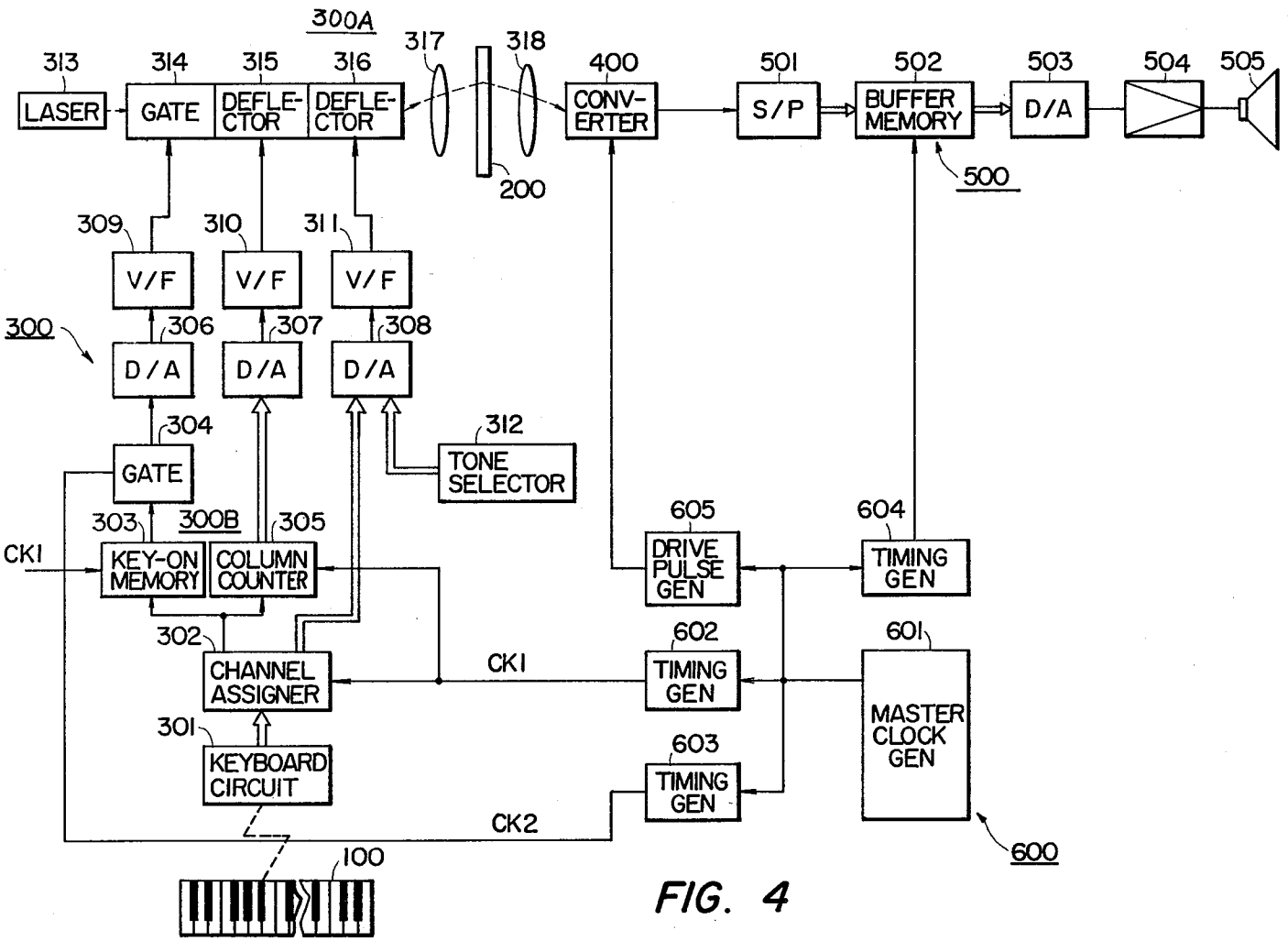
FIG. 4 is a block diagram of a total structure of an electronic musical instrument according to an embodiment of the present invention.

FIG. 4 shows a detailed entire structure of a polyphonic electronic musical instrument according to an embodiment of the present invention. For the convenience of description, this embodiment is constituted to have the ability of simultaneously generating musical tones for ten keys. The electronic musical instrument comprises: a keyboard 100 having N keys; a holographic memory 200; a tone waveshape reader 300 for reading out the tone waveshape information of depressed one to ten keys in the keyboard 100 from the holographic memory 200; a photo-electric converter means 400 for converting the optical image of the tone waveshape information which is read out from the holographic memory 200 to electric signals; an audio device 500 for converting the electric signals extracted from the photoelectric converter 400 to musical sounds of a real time base; and timing means 600 for providing timing of the above-said devices 300, 400, and 500.

Figure 5:
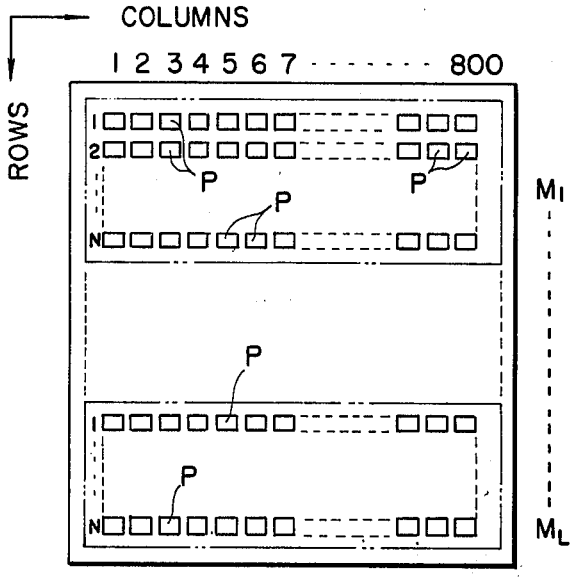
FIG. 5 is a schematic diagram of an example of the holographic memory used in the structure of FIG. 4.
Figure 7:
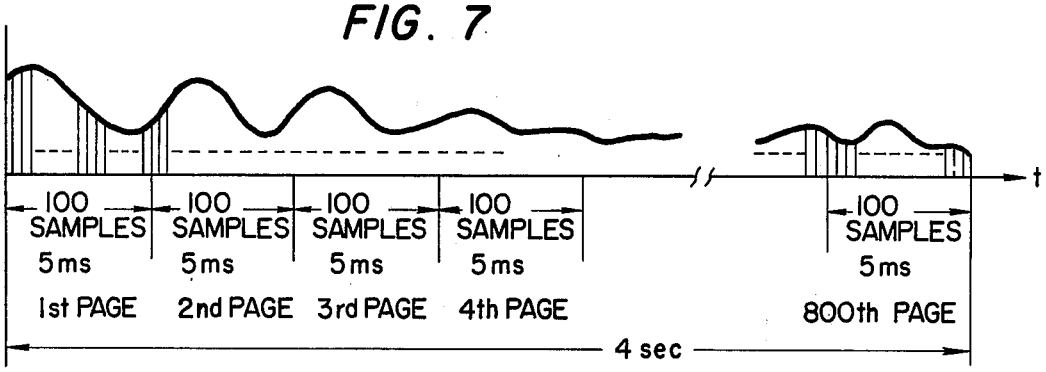
FIG. 7 is a schematic diagram for illustrating the sample values of the tone waveshape information to be stored in a row of pages in the holographic memory of FIG. 5.

The holographic memory 200 includes L matrices, each including N × 800 pages P arranged in N rows and 800 columns as shown in FIG. 5. The L matrices $M_1$ to $M_L$ are aligned vertically to form a composite matrix of L × N rows and 800 columns. Each page matrix $M_1$ to $M_L$ is assigned to store the musical tones for N keys of a particular tone color, e.g. of a natural musical instrument. The L matrices $M_1$ to $M_L$ thus provide L kinds of different musical instrument tones. Generation of different tone colors can be achieved by the selection of the page matrix $M_1$ to $M_L$. Respective rows in each of the page matrices $M_1$ to $M_L$ are assigned to N keys in the keyboard 100 (in one-to-one correspondence). The respective columns in each row of the page matrix $M_1$ to $M_L$ corresponds to the time axis of the tone generation. The duration of the tone generation is selected to be 4 seconds commonly for all the keys in this embodiment, for the convenience of description. Namely, the tone waveshape for this 4 seconds is divided into 800 segments and recorded in 800 columns of each row. Thus, each page P stores the tone waveshape information of a unit period of 4 s/800 = 5 ms (cf. FIG. 7). The recording method of the tone waveshape for each page P is as follows. First, the tone waveshape for each 5 ms unit period is sampled at timings of an interval of 0.418 μs per bit to provide 100 sample values for each of 10 channels for each 5 ms (cf. FIG. 9). Each of the 100 sample values is expressed by 10 bits in a digital notation, according to, for example, the PCM code. These 100 sets of digital signals are converted to dot real images of 100 sets of 10 bit, i.e. 1000 bits through optical means. These 100 sets of the dot images are arranged in the order of the sampling time and in a particular relative positional relationship. These 100 sets of dot real images, (namely 1000 dots), are totally converted to a hologram with a coherent light beam and is recorded in a page P, for example, of a size of 0.5 mm × 0.5 mm.

Figure 6:
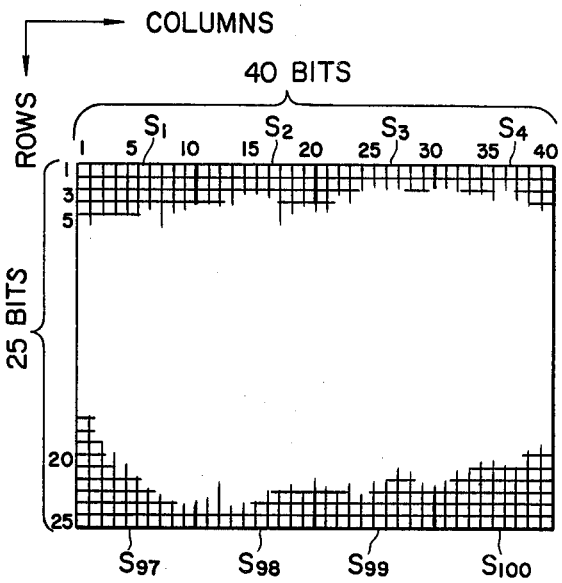
FIG. 6 is a schematic diagram for illustrating a dot pattern optical image of the tone waveshape information to be read out from each page area of the holographic memory and also for illustrating the arrangement of the image sensor elements in the photo-electric converter.

FIG. 6 illustrates an optical image of the tone waveshape information to be read out from one page P. The tone waveshape information in one page P is reproduced in a bright-and-dark dot pattern of 40 bits × 25 bits and projected on the photo-electric converter. The first sample value in page P is recorded in an elongated area $S_1$ of 10 bits located at the upper left corner; the second sample value is recorded in the next elongated area $S_2$ on the right side of the area $S_1$; . . .; the 99th sample value is recorded in the elongated area $S_{99}$; and the 100th (final) sample value is recorded in the elongated area $S_{100}$ at the lower right corner. Each dot represents 1 bit by the black-white level, and each elongated area including 10 dots represents 10 bits (1 sample value).

A tone waveshape reader 300 includes an optical system 300A for scanning the holographic memory 200, page after page, with a coherent light beam to produce successive optical images and a control circuit 300B for controlling the operation of the optical system 300A in response to the operations in the keyboard 100.

A keyboard circuit 301 of the control circuit 300B includes a group of key switches which are on-off operated in response to the operations of the respective keys in the keyboard 100 and generates key-on signals at the time of a key operation (key depression) and key-off signals at the time of another key operation (key release). A channel assigner 302 includes a key address memory which is capable of storing key address codes, the maximum number of which corresponding to the maximum number of simultaneously available (soundable) tones (ten in this embodiment) and the corresponding key-on signals with the mutual correspondence being held. Namely, ten channels are included in the channel assigner 302 and each channel stores the key address code and the key-on signal of one depressed key. The channel assigner 302 further includes means for searching an empty channel of the key address memory and for storing therein a key address code and also a key-on signal which is extracted from the keyboard circuit 301. The contents of the respective channels in the key address memory are cleared by the key-off signals which are generated from the keyboard circuit 301 when the corresponding keys are released. When a channel in the key address memory is cleared, a clear signal is generated therefrom to a key-on memory 303 and to a column counter 305. The contents in the first-to-the tenth channels of the key address memory of the channel assigner 302, i.e. the key address codes and the key-on signals, are successively read out in synchronism with the clock pulse $CK_1$ of a repetition period of 500 μs sent from the timing means 600; the key address code is supplied to a digital-analog (D/A) converter 308 and the key-on signal is supplied to the key-on memory 303 and to the column counter 305. Namely, in a period corresponding to a unit time period of a tone waveshape, 5 ms (see FIG. 7), the key address codes and the key-on signals for ten keys at the maximum are sent to the D/A 308, and to the key-on memory 303, and to the column counter 305 at a period of 500 μs. The clock pulse $CK_1$ is generated from a timing generator 602 consisting of a frequency divider, and other members, and being operative under the control of a master clock pulse generated from a master clock pulse generator 601.

The key-on memory 303 includes ten 1-bit memories corresponding to the respective channels of the key address memory of the channel assigner 302. Each 1-bit memory corresponding to one channel is set by the key-on signal delivered from the corresponding channel of the key address memory of the channel assigner 302 and is re-set by the clear signal. The contents of the 1st to the 10th channels of the key-on memory 303 are successively read out in synchronism with the clock pulse $CK_1$. The output of the key-on memory 303 is gated by a gate 304 and is supplied to a digital-analog converter (D/A) 306. This gate 304 is opend by a clock pulse $CK_2$ having a repetition period of 500 μs and a pulse width of 19.23 μs. This clock pulse $CK_2$ is formed in a timing generator 603 consisting of a frequency divider, a monostable multivibrator, and so forth, and is controlled by the master clock pulse of the timing means 600.

The column counter 305 includes the 1st to the 10th channel (+1)-counters corresponding to the respective channels in the key address memory of the channel assigner 302. Each (+1)-counter of the channel counts up +1 each time when it receives a key-on signal from the corresponding channel of the key address memory, and is cleared by the clear signal from the corresponding channel of the key address memory. The content of the (+1)-counter of each channel in the column counter 305 is read out in synchronism with the corresponding channels of the channel assigner 302 and the key-on memory 303 at the timing of the clock pulse $CK_1$ and is supplied to a D/A 307.

Figure 8:
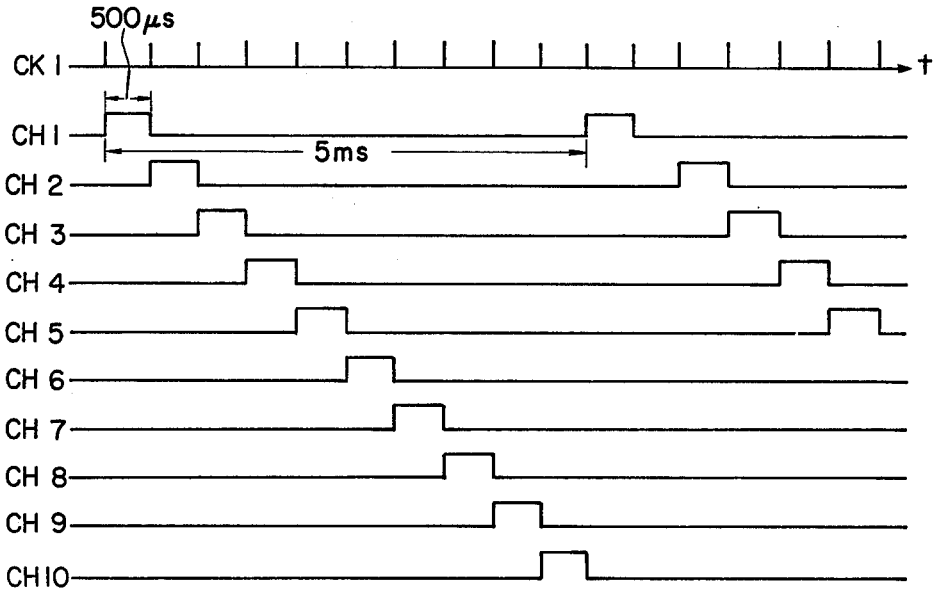
FIG. 8 is a time chart for illustrating the channel-assignment timing in the channel assigner of FIG. 4.

The timing relation of the respective reading operations of the channels of the channel assigner 302, the key-on memory 303 and the column counter 305 with respect to the clock pulse $CK_1$ is as shown in FIG. 8.

The D/A 306 converts the binary signal output of the key-on memory 303 which is supplied through the gate 304 to the corresponding analog voltage signal, and controls the oscillation frequency of a voltage-controlled frequency-variable oscillator (referred to as V/F hereinafter) 309. Similarly, the D/A 307 converts the count (digital signal) supplied from the column counter 305 to an analog voltage, and supplies it to a V/F 310 as the frequency controlling voltage. The D/A 308 converts the algebraic sum of the key address code which is supplied from the channel assigner 302 and also the matrix assigning code which is supplied from a tone color selector 312 to an analog voltage, and supplies the converted voltage to a V/F 311 as a frequency controlling voltage. The tone color selector 312 designates the particular one of the page matrices $M_1$ to $M_L$ on the holographic memory 200 from which the tone waveshape information is to be read out. The matrix assigning code is uniquely determined for the respective matrices $M_1$ to $M_L$.

The optical system 300A of the tone waveshape reader 300 includes a laser beam source 313, a laser beam gate 314, a pair of laser beam deflectors 315 and 316, an expanding lens 317 and a Fourier reverse-transformation lens 318. The combination of the laser beam gate 314 and the pair of laser beam deflectors 315 and 316 may be formed of a known ultrasonic light deflector which is a combination of a transparent dielectric bulk of tellurium oxide $TeO_2$, and the like, and a piezoelectric element working as an ultrasonic wave generator. The deflecting angle of the ultrasonic light deflector is determined by the frequency of the controlling voltage applied to the piezoelectric element.

The laser beam gate 314 largely deflects the laser beam from the laser beam source 313, and prevents its injection onto the next stage laser beam deflector 315 when the gate 314 is closed, and when the gate 314 is opened, the 1-bit memory of the read-out channel of the key-on memory 303 is re-set. When the gate 314 is open and the 1-bit memory of the read-out channel of the key-on memory is set, the laser beam from the laser beam source 313 transmits the laser beam gate 314 and injects onto the laser beam deflector 315.

Figure 9:
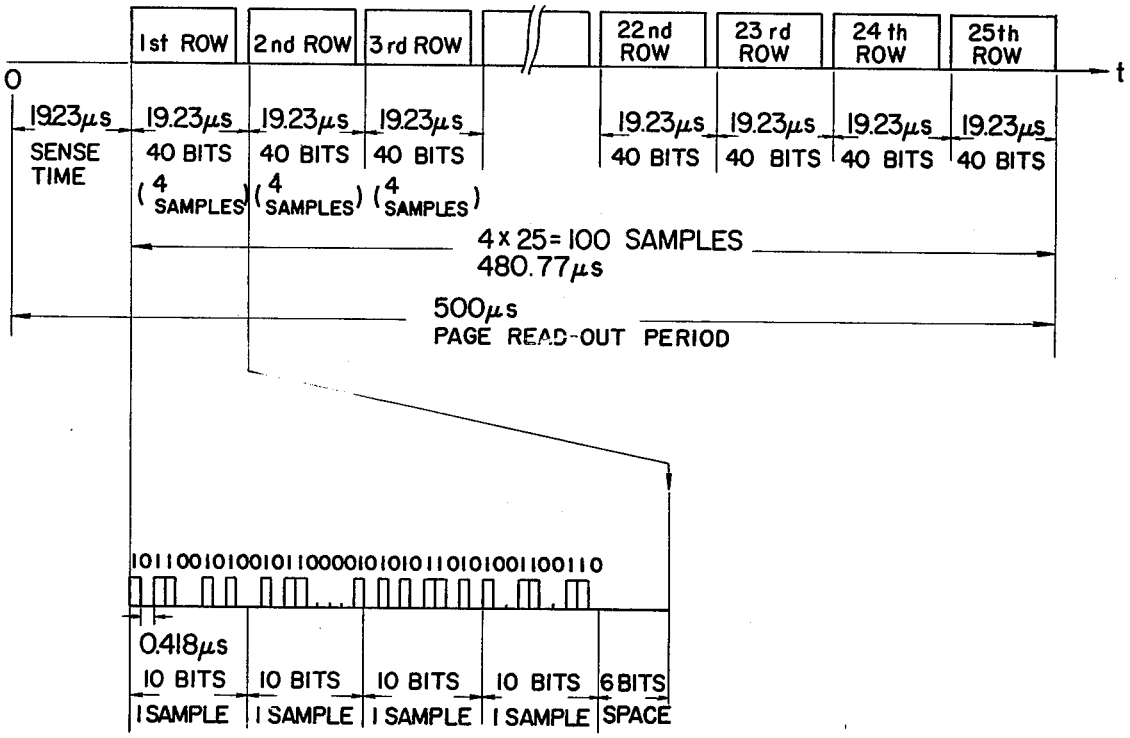
FIG. 9 is a time chart for illustrating the read timing in the photo-electric converter of FIG. 4.

The laser beam deflector 315 deflects the incident laser beam from the laser source 313 through the gate 314 in the direction of column of the holographic memory 200, i.e. to scan the successive columns in a row. The laser beam deflector 316 of the next stage deflects the laser beam transmitted through the fore-stage deflector 315 in the direction of row of the holographic memory 200, i.e. to select a row of a desired tone color and pitch. The laser beam having been deflected by the dual stage light deflectors 315 and 316 is then directed onto a spot (page) in the holographic memory 200 through an expansion lens 317. The deflection angles in the laser beam deflectors 315 and 316 are controlled by the frequencies of the outputs of the V/F 310 and 311, respectively. Let us now assume here that the tone color selector 312 designates the first matrix $M_1$ and that the first channel of the key address memory of the channel assigner 302 stores "1" representing the first key in the keyboard 100. When the first read timing of the first channel comes, the (+1)-counter of the first channel of the column counter 305 supplies a code representing the count "1" to the D/A 307. The output of this D/A 307 controls the oscillation frequency of the V/F 310. Thus, for the period while the laser beam gate 314 is open (for the pulse width of the clock pulse $CK_2$, 19.23 μs), the laser beam is caused to impinge onto page P at the first row, the first column of the first matrix $M_1$ of the holographic memory 200. At the second read timing of the first channel, the (+1)-counter of the first channel of the column counter 305 is counted up by +1 to make the count "2" and the page P at the first row, the second column is irradiated by the laser beam. In this way, every time when the read timing of the first channel comes, the pages in the succeeding columns in the first row of the first matrix $M_1$ are scanned one by one in the direction of the column. This scanning continues until the operation (key depressed) of the first key in the keyboard is terminated (key released). When the key is released, the first channel key address memory of the channel assigner 302 and the first channel (+1)-counter of the column counter 305 are cleared and the first channel 1-bit memory of the key-on memory 303 is re-set. Circuit operations are similar for other keys. In such a manner, the pages in ten rows, at the maximum, in a page matrix $M_1$ to $M_L$ corresponding to ten keys are successively scanned by a laser beam in the column direction in the time-sharing fashion from the respective commencements of the keys. The diameter of the laser beam spot irradiated onto a page P gives an influence onto the brightness of the optical image of the tone waveshape to be read out, but the dispersion in the spot size does not give any influence to the accuracy of the reproduced optical image. In particular, when the tone waveshape information is first converted to dot real image and then transformed into a halogram as in the present embodiment, no problem arises from the dispersion of the spot size of the laser beam, provided that the black-white brightness level of each dot can be discriminated by the photo-electric converter 400. The tone waveshape information read out from each page P of the page matrix $M_1$ to $M_L$ of the holographic memory is returned into real images of dots by a Fourier reverse-transformation lens 318 onto the photo-electric converter 400 in the dot pattern as shown in FIG. 6. The photo-electric converter 400 is formed of a self-scanning type image sensor, similar to the Fairchild model "CCD201", having a matrix arrangement of image sensor elements of 40 bits (columns) × 25 bits (rows) corresponding to the dot pattern of the read-out optical image of FIG. 6. The reading timing of this photo-electric converter 400 is shown in FIG. 9. Each reading period for one page is 500 μs in which the optical image of the tone waveshape information in one page which is read out from the holographic memory 200 is converted to electric quantities and are stored thereat in the sense time period of 19.23 μs (the timing of the clock pulse $CK_2$). In the next 19.23 μs period (46 bit times), the stored charges for the 40 bits in the first row (corresponding to areas $S_1$ to $S_4$ of FIG. 6 and representing the sample values at the initial four sampling points in the unit period of the tone waveshape recorded in this page) are converted to binary electric signals and are shifted out serially. Similarly, binary signals of 40 bits per 19.23 μs corresponding to the stored charges are shifted out serially. The operation timing of this photo-electric converter 400 is controlled by a drive pulse generated from a drive pulse generator 605 actuated in synchronism with the master clock pulse of the timing means 600.

The serial signal outputted from the photo-electric converter 400 is then inputted into an audio device 500. This audio device includes a serial-parallel converter (referred to as S/P hereinbelow) 501 for converting each serial signal supplied from the photo-electric converter 400 into a parallel signal of ten bits, a buffer memory 502 for conducting the time scale transformation, a digital-analog converter (D/A) 503, an amplifier 504 and a loudspeaker 505.

Figure 10:
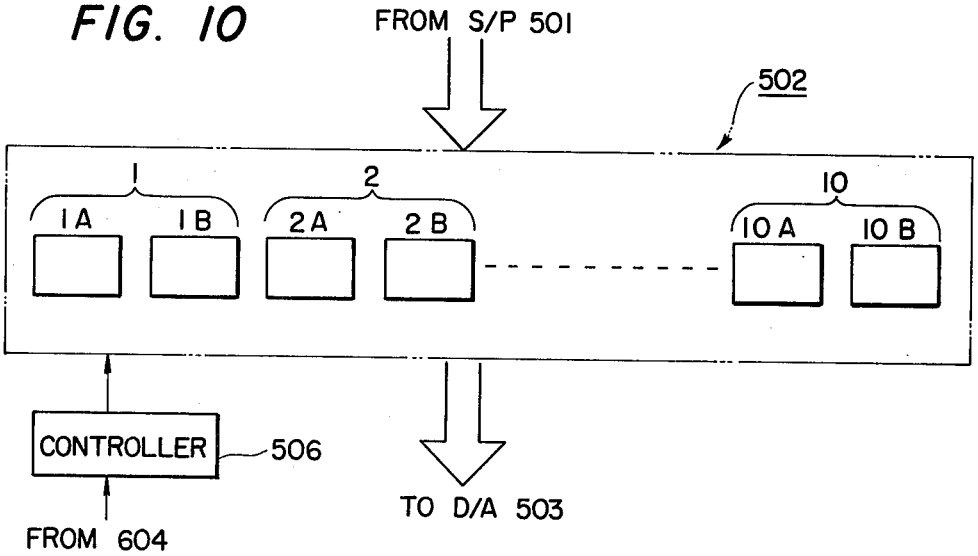
FIG. 10 is a schematic block diagram of a structure of a buffer memory of FIG. 4.
Figure 11:
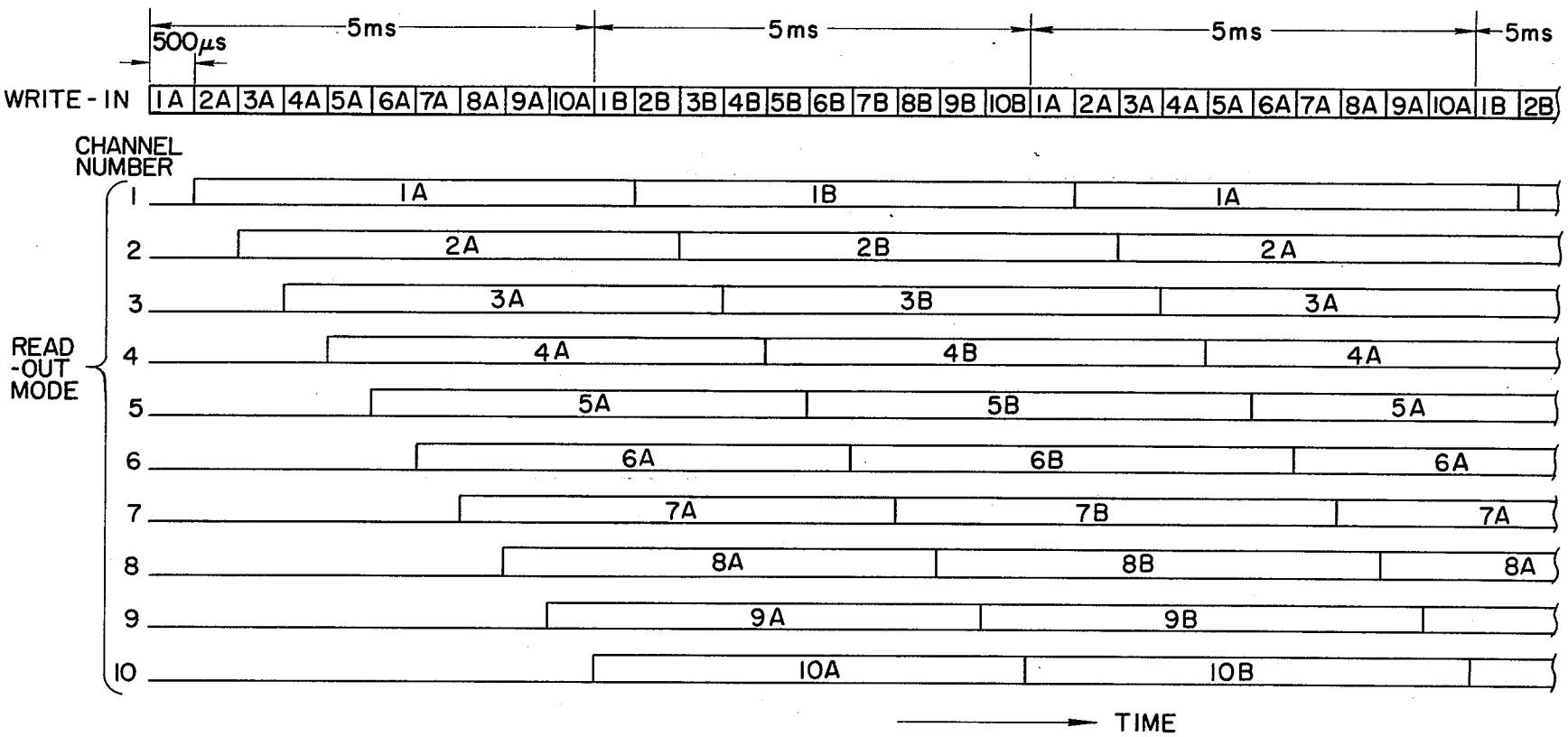
FIG. 11 is a time chart for illustrating the timing of the write and read modes of the respective channels in the buffer memory of FIG. 10.

As shown in FIG. 10, the buffer memory 502 includes 20 registers 1A, 1B, 2A, 2B, . . ., 10A and 10B, each of 100 words × 10 bits, and a controller 506 for controlling the addressing of the respective registers, and the timing of read and write of the respective registers. Pairs of registers 1A and 1B, 2A and 2B, . . ., and 10A and 10B work in correspondence with the first, second, . . ., and the 10th channels. The operation timing of the controller 506 is controlled by the timing pulse supplied from a timing generator 604 which is actuated in synchronism with the master clock pulse of the timing means 600. The timing of the read and write of the respective registers 1A to 10B of the buffer memroy 502 is shown in FIG. 11. Namely, when the channel assigner 302 assigns the first channel, the serial signals of the tone waveshape information supplied from the photo-electric converter 400 are converted to parallel signals, each of 10 bits in the S/P 501 and written in the register 1A successively. Thus, 100 words data (10 bits per word) representing the 100 sample values recorded in a page of the holographic memory 200 are stored in the register 1A in 500 μs period. When this write-in cycle is terminated, the read-out cycle of this register 1A is initiated, and the 100 sets of sample values are successively sent out at the interval of 50 μs from the earliest to the latest, each in parallel fashion (10 bits for 1 sample simultaneously). Similarly, when the channel assigner 302 assigns the second, third, . . ., and the 10th channel, the second, third, . . . and the 10th channel register 2A, 3A, . . ., and 10A are activated to accomplish the write-in cycle (500 μs) and the succeeding read-out cycle (5 ms). Then, when the channel assigner 302 assigns the first, second, . . ., the 10th channels successively in the next turn, the first, second, . . ., the 10th channel registers 1B, 2B, . . ., 10B of the buffer memory 502 are successively activated to accomplish the write-in cycle and the succeeding read-out cycle. In this way, the tone waveshape information which is read out from the holographic memory 200 by the tone waveshape reader 300 in the time-sharing manner at the rate of 500 μs per page is expanded into the tone waveshape on the real time base (5 ms) in the buffer register 502.

The output of the buffer register 502 is converted to an analog voltage signal in the D/A 503 and is inputted into the amplifier 504 to be amplified therein and is reproduced as a musical sound by a loudspeaker 505.

Figure 12:
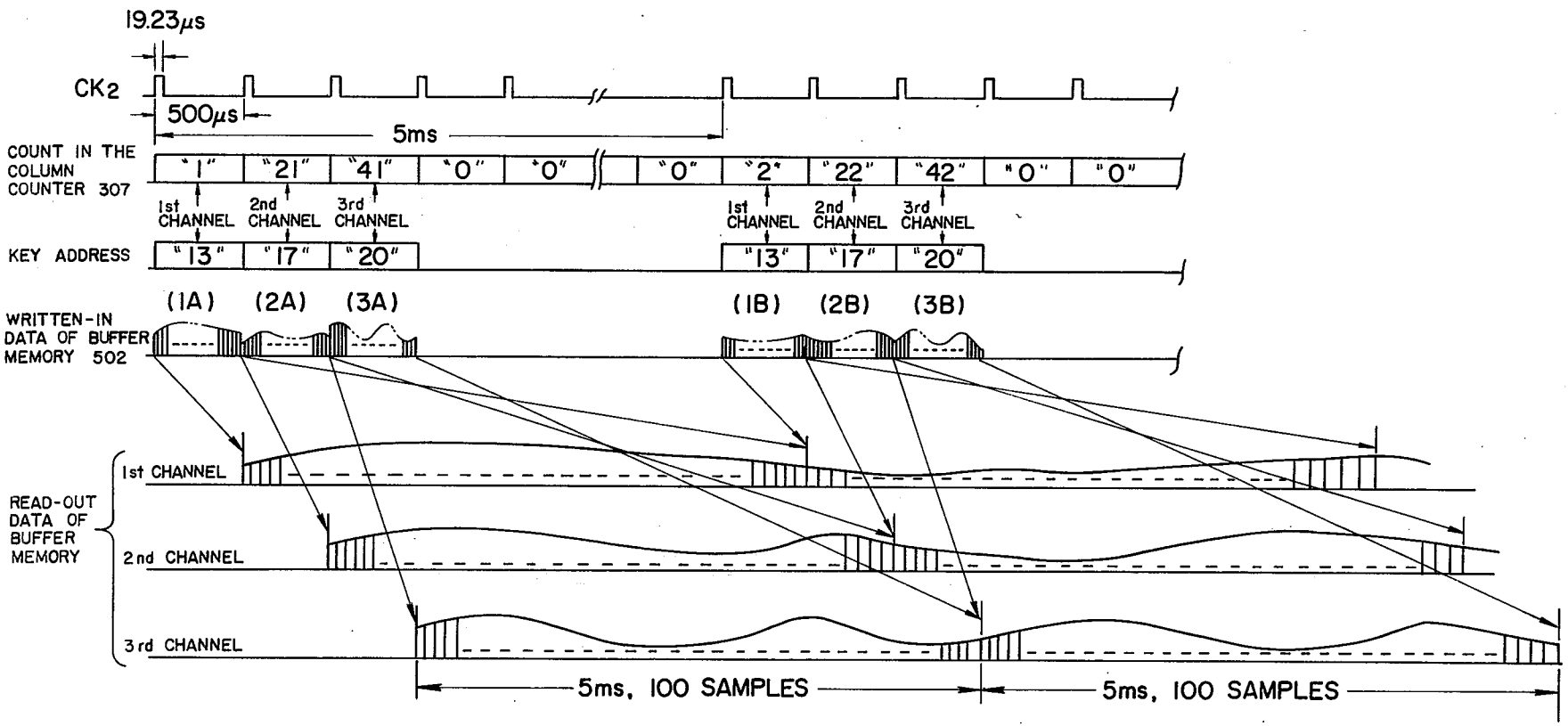
FIG. 12 is a timing diagram for illustrating the time-sharing reading and the time scale transformation of the tone waveshape information in the electronic musical instrument of FIG. 4.

Next, the operation in the instance when three keys in the keyboard 100 are operated simultaneously will be described by referring to FIG. 12. It is assumed here that the key No. 13 is operated and the corresponding key address code and key-on signal are stored in the first channel of the key address memory of the channel assigner 302, and that the key No. 17 and the key No. 20 have been operated and the corresponding key address codes and key-on signals have been stored in the second and the third channels of the key address memory of the channel assigner 302, respectively. Furthermore, it is assumed that, at the commencement of the operation of the key No. 13 the (+1)-counters of the second and the third channels of the column counter 305 have counted up to "21" and "41", respectively. When the channel assigner 302 successively reads out the first, second, third, . . ., tenth channels, pages at the 13th row, first column, 17th row, 21st column, 20th row, 41st column in a particular page matrix $M_1$ to $M_L$ of the holographic memory 200 designated by the tone color selector 312 are successively scanned by the laser beam in synchronism with the clock pulse $CK_2$ to read out the optical images of the tone waveshape information recorded in the respective pages. At the same time, the (+1)-counters of the first, the second, and the third channels cont up each +1. Thus, the read-out optical images of the tone waveshape information corresponding to the 13th, 17th and 20th keys are converted to binary and serial electric signals in a photo-electric converter 400, then converted to parallel signals, each of 10 bits, in the S/P 501, and then written in the registers 1A, 2A and 3A (or 1B, 2B and 3B) of the first, the second and the third channels of the buffer memory 502, respectively. Thus, 100 word data (10 bits per word) representing 100 sample values of the tone waveshape recorded in a corresponding page are stored in each of the registers 1A, 2A and 3A (or 1B, 2B and 3B). Each of the registers 1A, 2A and 3A (or 1B, 2B and 3B) achieves the read-out cycle immediately after the write-in cycle is terminated, and supplies the data representing the respective sample values to the D/A 503 on the real time base. Then, when the first, second, third . . . , and 10th channels are successively read out again by the channel assigner 302, the pages P at 13th row, 2nd column, 17th row, 22nd column, and 20th row, 42nd column of the selected page matrix $M_1$ to $M_L$ are successively scanned by the laser beam. Then, the respective (+1)-counters of the first, the second and the third channel of the column counter 305 count up by each "+1". Similarly, the tone waveshape information stored in the respective pages of the 13th, 17th, and 20th rows of the particular page matrix $M_1$ to $M_L$ designated by the tone color selector 312 are successively read out and reproduced as musical sounds from the audio device 500. Here, it will be apparent that the mixture of the musical sounds corresponding to the key Nos. 13, 17 and 20 is generated from the loudspeaker 505.

According to the above embodiments, the amplitude and the pitch of a generated musical tone do not vary with the touch of the key operation. The so-called touch responsive after-control which controls the amplitude level and the tone pitch of the generated musical sound in response with the touch of the key operation may be effected by introducing the technique well known in the field of the electronic musical instrument. For example, the keyboard circuit 301 may be modified to generate a key-touch signal representing the strength or speed of the key operation (depression) for each operated key, while another D/A having ten channels therein may be provided in correspondence with the respective channel registers of the buffer memory 502 to supply the outputs of the respective channels of the D/A 503 to the amplifier 504 through variable gain amplifiers. The touch signals are applied to the variable gain amplifiers of the corresponding channels through the channel assigner 302 to control the gain of the variable gain amplifiers by the touch signals of the corresponding keys. By such arrangement, the amplitude of the generated musical tones can be controlled by the touch of the key operation. Similarly, the pitch of the generated musical tone can also be controlled in response to the touch of the key operation, for example by providing variable delay elements such as the known charge-coupled device (CCD), etc. in place of or in series to the variable gain amplifiers for controlling the frequency of the transfer clock of the variable delay elements by the above touch signals.

Yet, further, according to the above-stated embodiment, the reproduction of a musical tone is terminated immediately after the key operation is released. But such unnaturalness of abrupt stop can be easily removed. For example, the contents of the key address memory of the channel assigner 302 and the 1-bit memory of the key-on memory 303 may be held for a certain period even after the key operation is released, so as to continue the scanning of the holographic memory 200 corresponding to such keys. Further, a desired decaying characteristic may be afforded to said touch signal and the gain of the variable gain amplifier may be controlled by such touch signal to provide a desired decaying characteristic to the generated musical tones.

What is claimed is:

1. In an electronic musical instrument of the waveshape memory type comprising: a keyboard having a plurality of keys; memory means storing the information of musical tone waveshapes corresponding to said keys; tone waveshape reader means for reading out the tone waveshape information corresponding to those operated keys among said plurality of keys from said memory means; signal converter means for converting the tone waveshape information read out by said tone waveshape reader means to electric signals; and an audio device for converting the electric signal outputted from said signal converter means to a musical tone, the improvement comprising:

said memory means including a holographic memory carrying holograms of tone waveshape information in regions corresponding to the respective keys in the keyboard;

said tone waveshape reader means including an optical system for irradiating a coherent light beam on a region of the hologram of the tone waveshape information corresponding to an operated key in said keyboard to generate an optical image of the tone waveshape information recorded in said region; and said signal converter means converting said optical images to electric signals.

2. The improvement according to claim 1, in which: said holographic memory includes a matrix of pages arranged in rows and columns, each page carrying tone waveshape information for a single key in a certain time period, successive column pages in each row representing the time change of the tone waveshape.

3. The improvement according to claim 1, in which: said holograms store digital-coded tone waveshape information and said audio device includes a digital-analog converter.

4. The improvement according to claim 2, in which: said tone waveshape reader means further includes a control circuit unit and said optical system comprises a coherent light source for emitting a coherent light beam, and light deflecting means for deflecting the coherent light beam emitted from the coherent light source, said light deflecting means deflecting the coherent light beam under the control of said control circuit unit so as to scan, with said coherent light beam, the pages in a row selected by a key operation in the keyboard in the direction of columns from the commencement of the key operation along with the lapse of time.

5. The improvement according to claim 2, in which: each of said pages of the holographic memory is a hologram of a dot matrix, and said signal converter means includes a matrix of photo-electric detectors.

6. The improvement according to claim 5, in which: said signal converter is a self-scanning type image sensor.

* * * * *